US011629029B2

(12) United States Patent
Lombardi et al.

(10) Patent No.: US 11,629,029 B2
(45) Date of Patent: Apr. 18, 2023

(54) FOLDING, OR INTERFOLDING, UNIT FOR FOLDING, OR INTERFOLDING SHEETS OF PAPER FOR A MACHINE FOR PAPER CONVERTING

(71) Applicant: M.T.C.—MACCHINE TRASFORMAZIONE CARTA S.R.L., Lucca (IT)

(72) Inventors: Sergio Lombardi, Viareggio (IT); Paolo Casotti, Lucca (IT); Alessandro Morelli, Lucca (IT)

(73) Assignee: M.T.C.—MACCHINE TRASFORMAZIONE CARTA S.R.L., Porcari (IT)

( * ) Notice: Subject to any disclaimer, the term of this patent is extended or adjusted under 35 U.S.C. 154(b) by 78 days.

(21) Appl. No.: 17/428,349

(22) PCT Filed: Jan. 30, 2020

(86) PCT No.: PCT/IB2020/050731
§ 371 (c)(1),
(2) Date: Aug. 4, 2021

(87) PCT Pub. No.: WO2020/161571
PCT Pub. Date: Aug. 13, 2020

(65) Prior Publication Data

US 2022/0127103 A1 Apr. 28, 2022

(30) Foreign Application Priority Data

Feb. 4, 2019 (IT) ..... 102019000001579

(51) Int. Cl.
*B65H 45/24* (2006.01)
*B65H 45/28* (2006.01)

(52) U.S. Cl.
CPC ..... *B65H 45/24* (2013.01); *B65H 45/28* (2013.01); *B65H 2701/1924* (2013.01)

(58) Field of Classification Search
CPC ..... B65H 45/24; B65H 45/28
See application file for complete search history.

(56) References Cited

U.S. PATENT DOCUMENTS 843,781 A * 2/1907 Wheeler ..... B65H 45/30 493/418
3,490,762 A 1/1970 Nystrand
(Continued)

FOREIGN PATENT DOCUMENTS

CN 102 431 833 A 5/2012
EP 1 457 444 A2 9/2004
(Continued)

*Primary Examiner* — Patrick H Mackey
(74) *Attorney, Agent, or Firm* — Maschoff Brennan

(57) ABSTRACT

A folding, or interfolding, unit, for folding, or interfolding, a first and a second plurality of sheets of paper in a machine for converting paper, comprises a first and a second folding, or interfolding, counter-rotating rolls configured to rotate about a respective longitudinal rotational axis and providing a plurality of suction holes. A vacuum generation device and a vacuum distribution device are, furthermore, provided for selectively putting into pneumatic communication the vacuum generation device with at least a row of the aforementioned suction holes. The folding, or interfolding, unit, comprises, furthermore, a first and a second cutting device providing, respectively, at least a first and a second cutting blade which cooperates with a first and a second plurality of counter-blades distributed along the folding, or interfolding rolls in order to cut a first and a second web of paper, in the first and in the second plurality of sheets.

20 Claims, 9 Drawing Sheets

(56) References Cited

U.S. PATENT DOCUMENTS

| | | | | |
|---|---|---|---|---|
| 4,070,014 | A * | 1/1978 | Takahashi | B65H 45/24 493/413 |
| 4,770,402 | A | 9/1988 | Couturier | |
| 5,147,273 | A * | 9/1992 | Rottmann | B65H 45/24 493/430 |
| 6,213,927 | B1 * | 4/2001 | De Matteis | B65H 45/24 493/359 |
| 6,228,014 | B1 * | 5/2001 | De Matteis | B65H 29/56 493/425 |
| 7,306,554 | B2 * | 12/2007 | Couturier | B65H 45/24 270/39.02 |
| 8,029,429 | B2 * | 10/2011 | Tsai | B31F 1/10 493/401 |
| 8,282,090 | B2 * | 10/2012 | Walsh | B65H 45/20 270/39.02 |
| 2006/0154794 | A1 | 7/2006 | Couturier et al. | |

FOREIGN PATENT DOCUMENTS

| | | | |
|---|---|---|---|
| EP | 1 520 822 | A2 | 4/2005 |
| EP | 1 630 118 | A1 | 3/2006 |
| GB | 1 479 299 | A | 7/1977 |
| IT | B020 080 167 | A1 | 9/2009 |
| WO | 2011/072542 | A1 | 6/2011 |
| WO | 2018/019679 | A1 | 2/2018 |

* cited by examiner

Fig. 1
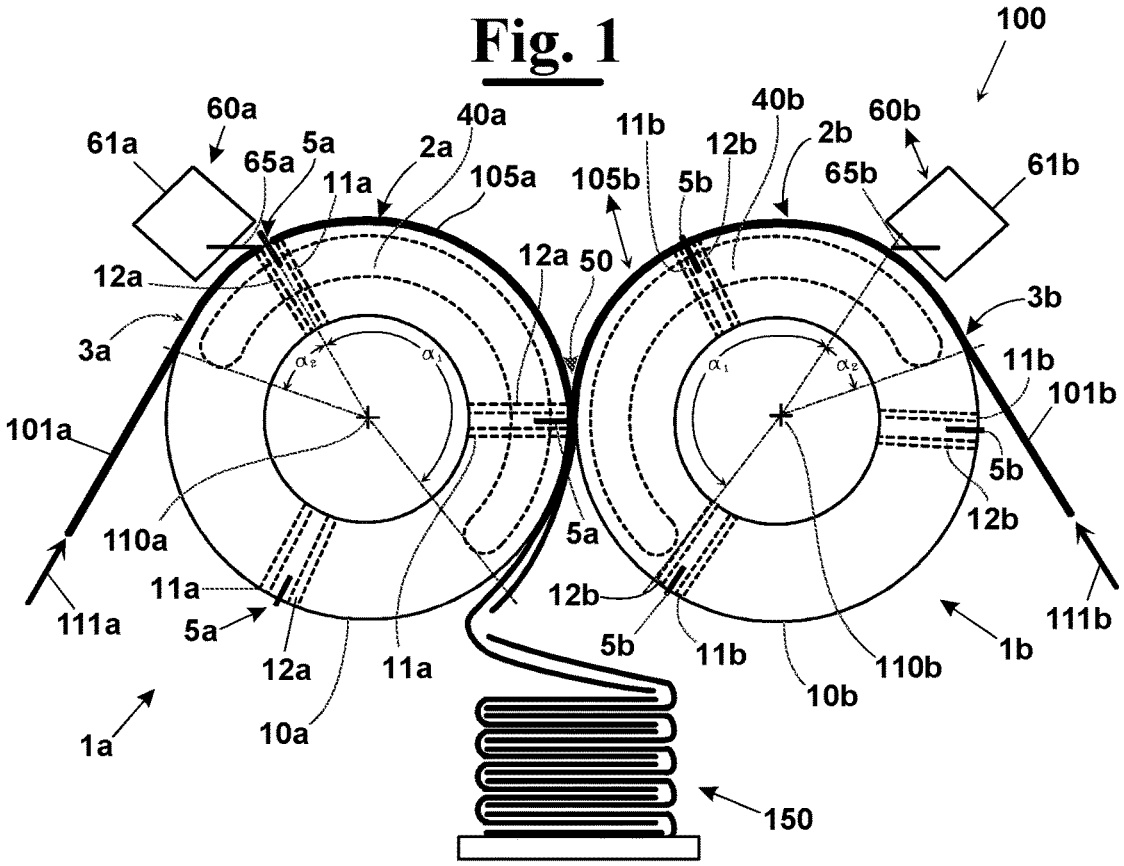
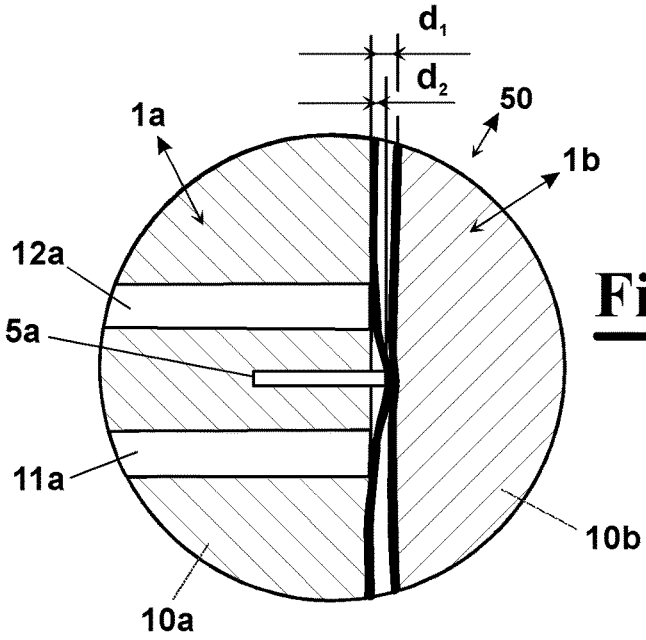
Fig. 2

Fig. 3
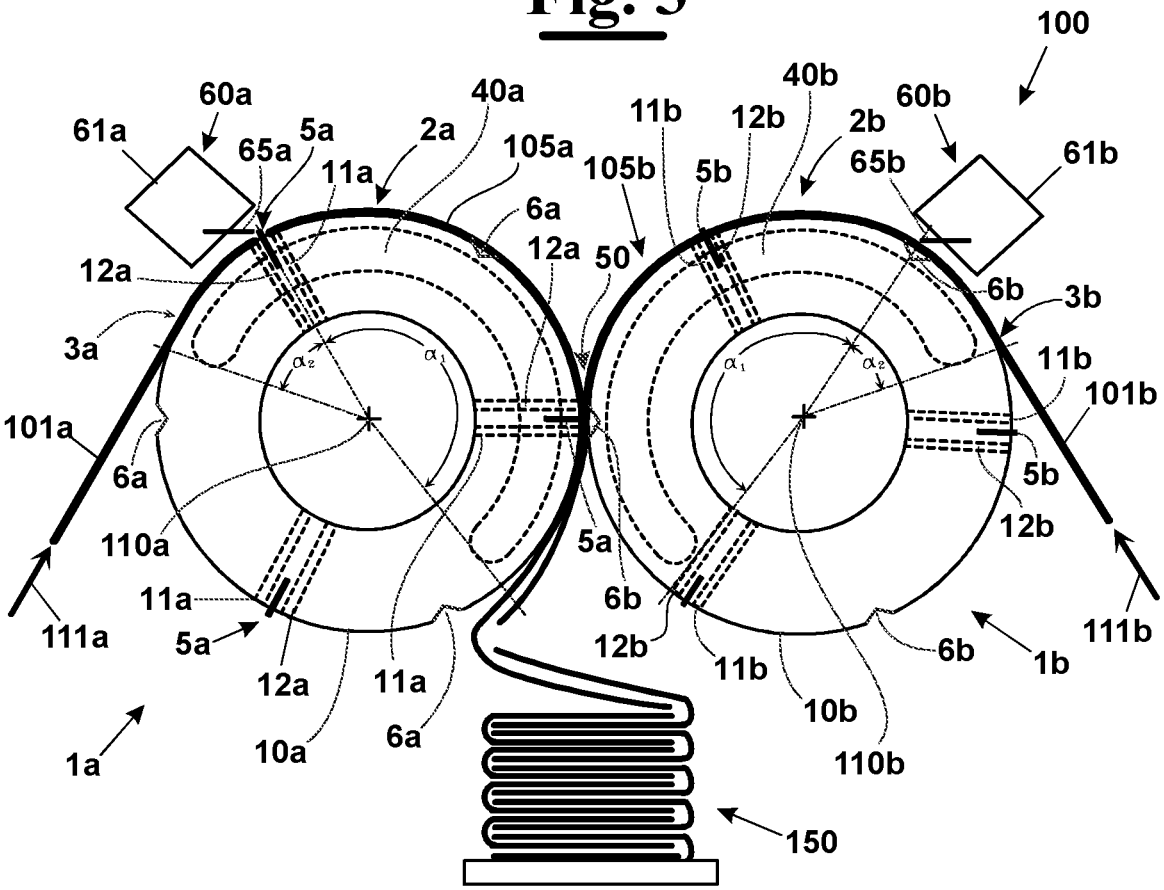
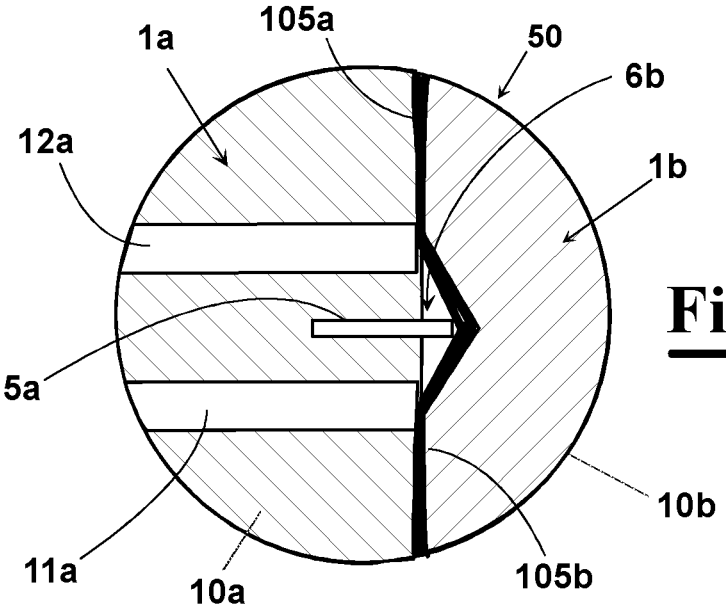
Fig. 4

FOLDING, OR INTERFOLDING, UNIT FOR FOLDING, OR INTERFOLDING SHEETS OF PAPER FOR A MACHINE FOR PAPER CONVERTING

FIELD OF THE INVENTION

The present invention relates to the technical field of paper converting and related products, and, in particular, relates to a machine for interfolding a web, or sheet of paper, equipped with at least an innovative folding, or interfolding, unit, in particular that is able to cut a web into sheets of predetermined length before folding, or interfolding, the same.

DESCRIPTION OF THE PRIOR ART

As it is known, in the paper industry different kinds of machines and processes are used for producing tissues, towels and similar products in stacks of interfolded sheets having a determined height. These are obtained by folding the sheets in an "interfolded" way, i.e. closing, at each fold, a final border of the previous sheet and an initial border of the following sheet.

In this way, at the moment of using the same, when a sheet is extracted from the stack, also an initial border of the following sheet is extracted, thus simplifying the use of the same.

The interfolding machines of prior art work one, or more, webs of paper coming from one, or more bobbins, that are cut at a cutting unit, in sheets of predetermined length and fed staggered at a folding unit at which two counter-rotating folding rolls work. More precisely, the cut of the sheets of the webs is carried out on cutting rolls, which cooperate with respective counter-blades.

Among the possible ways to fold the sheets, in particular, the 2 panels "L"-interfolded, the 3 panels "Z"-interfolded, and the 4 panels "W"-interfolded, are known.

In the case of "L"-interfolded, which are produced with machines known as "single-fold", for example of the kind described in U.S. Pat. No. 6,228,014, the webs of paper are cut in such a way to form two staggered sequences of sheets that are alternately fed to the folding rolls. In this way, each sheet coming from a first direction is overlapped, for about half sheet, to a portion of the sheet coming from a second direction, and vice versa, at the moment in which the fold is carried out.

In the case of "Z", "W", or even more interfolded panels, that are obtained by machines known as "multi-fold" machines of the kind for example described in U.S. Pat. No. 3,490,762, a single web of paper is processed and a sequence of sheets that are already partially overlapped arrive from a single direction. As described in EP1520822, the overlapping between two following sheets is carried out immediately after the cut by a transfer roll and a delay roll, which produce, together, a small fold in a previous sheet under which the following sheet at least in part positions.

Both in the single-fold machines and in the multi-fold machines, the folding rolls have a circumference whose length is a multiple of the panel length. In particular, in order to carry out the folding, or interfolding, of the sheets, the folding rolls provide retaining devices, such as for example suction holes, or mechanical pliers, that are synchronously activated for alternately starting and finishing each fold between two successive panels.

For example, as described in EP1457444B1 which comprises advancing and folding rolls having suction holes, a first series of holes keeps the sheets on a folding roll for a determined angular distance, and then "passes" the same to the other folding roll also this provided of a parallel retaining device with suction holes, which operates at another predetermined angular distance. This controlled "passage" of the sheet, or web, of paper from a folding roll to the other one, the desired folding, or interfolding configuration and therefore a stack of interfolded, or folded, sheets is obtained. The "panel length", which determines the width of the stack of folded sheets exiting the machine, being a submultiple of the planar development of the folding rolls, is, therefore, one of the main constructive constraints of the folding machines, which prevents to change the panel length without completely replacing the folding rolls.

Therefore, both in the case of prior art multi-fold machines, and in the case of prior art single-fold machines, it is necessary to provide both folding, or interfolding, rolls and at least a cutting roll, in addition to the rolls for transferring the sheets from the cutting roll to the folding, or interfolding, rolls. Therefore, besides being complex from a constructive point of view, the prior art machines have a big size. In the prior art machines is, furthermore, necessary to have both cutting rolls and folding, or interfolding, rolls, of suction type, thus having a high energy consumption for producing the vacuum necessary for the suction.

Furthermore, both the multi-fold machines, and the single-fold machines of prior art, are not able to produce different kind of products, because, as above described, both the folding, or interfolding, rolls as well as the cutting rolls, have a predetermined circumference whose length is a multiple of the panel length, whereby they are able to produce only a specific kind of product.

In EP1630118, in the name of the same applicant, a folding machine is described having a framework comprising a folding section in which the sheets are fed to the folding rolls and, therefore, folded in such a way to obtain a determined interfolding configuration. The folding section provides a modular structure comprising a removable portion in order to be replaced with a portion equivalent, but adapted to operate with a different panel length.

Even though the solution described in EP1630118 allows to obtain a machine having a certain flexibility, however, it needs long times for carrying out the replacement of a module with an equivalent one with a consequent high loss of productivity. In fact, the replacement of the folding section is very complicated because it involves both the folding and the cutting rolls.

Another kind of interfolding machine is described in WO2018/019679. More precisely, the interfolding machine provides a folding unit comprising a first and a second folding roll positioned downstream of a respective cutting unit. This provides a fixed cutting blade adapted to operate in combination with a respective counter-cutting blade for each side of the machine. The cutting unit cuts a first and a second web of paper in a respective plurality of sheets that is fed to a respective folding roll of the folding unit. This in addition to the folding rolls, provides a first and a second plurality of the removing fingers that are moved in phase with respective folding rolls for causing the sheets to be removed from the external surface of the same. Separator members are, furthermore, provided for carrying out the separation of a finished stack of interfolded sheets from the following forming stack. Both the removing fingers and the separator elements of WO2018/019679 are moved within respective grooves that are peripherally provided on the folding rolls, that means that the displacement trajectory of the same during the folding step carried out by the folding unit are positioned inside the encumbrance of the folding rolls. Notwithstanding WO2018/019679 refers to the possibility that the cutting rolls can be not present in the machine and that the cutting blades can be directly mounted on the folding rolls, however, since WO2018/019679 does not describe these alternative solutions of the removing fingers and the separator members, also in this case these components will be made as above described. Therefore, the resulting interfolding machine is not able to work because the removing fingers, and even more the separator members, at the separation zone will unavoidably interfere with the cutting blades mounted on the folding rolls, thus making impossible to carry out the folding step and the separation step.

Another solution having similar drawbacks is also described in CN102431833.

SUMMARY OF THE INVENTION

It is therefore an object of the present invention to provide a folding, or interfolding, unit, that is able to overcome the aforementioned drawbacks of the folding, or interfolding, unit of prior art.

It is, in particular, an object of the present invention to provide a folding, or interfolding, machine, equipped with a folding, or interfolding, unit, as above described and having a small encumbrance and a reduced energy consumption with respect to the prior art machines.

It is also an object of the present invention to provide a folding, or interfolding, machine, equipped with a folding, or interfolding, unit, as above described and that is able to operate at high speed without compromising the quality of the final product.

It is a further object of the present invention to provide a method for producing folded or interfolded products having the aforementioned advantages with respect to the prior art methods.

These and other objects are achieved by a folding, or interfolding, unit, for folding, or interfolding a first and a second plurality of sheets of paper of predetermined length and arranged to be folded, or interfolded, at a predetermined folding, or interfolding, zone, of a machine for converting paper, or similar product, said folding, or interfolding, unit comprising a first and a second folding, or interfolding, counter-rotating rolls between which said folding, or interfolding, zone, is defined, each of said first and second folding, or interfolding, rolls being provided with:

- a tubular body configured to rotate about a respective longitudinal rotational axis, and providing a plurality of suction holes organized according to a plurality of couples of longitudinal rows close to each other;
- a vacuum generation device configured to produce a predetermined vacuum degree;
- a vacuum distribution device configured to selectively put into pneumatic communication said vacuum generation device with at least a row of said plurality of rows of suction holes, at predetermined angular positions of said tubular body, in such a way to cause said plurality of processed sheets of paper to be sucked and therefore to adhere at predetermined portions of said first, or second, folding, or interfolding, roll;
- a separation unit arranged to operate downstream of said folding, or interfolding, unit, said separation unit comprising a first and a second plurality of separator members configured to enter from opposite sides in a finished stack of folded, or interfolded, sheets, and separate the same from a following forming stack of folded, or interfolded, sheets;
- a displacement unit configured to move said first plurality of separator members and said second plurality of separator members;

whose main characteristic of said folding, or interfolding, unit, is that it comprises, furthermore, a first and a second cutting device, associated, respectively, to said first and to said second folding, or interfolding, roll, said first and second cutting devices being, respectively, provided of at least a first and a second cutting blade and that each said first and second folding, or interfolding, roll provides, respectively, a first and a second plurality of counter-blades distributed along said respective tubular body and configured to operate, respectively, in combination with said first and second cutting blade for dividing a first and a second web of paper, or similar product, in said first and said second plurality of sheets and that said displacement unit is configured to move said first and second plurality of separator members between a first position and a second position along a respective displacement trajectory positioned outside the encumbrance of said first and second folding, or interfolding, roll during the formation of said stack of folded, or interfolded, sheets in such a way not to intersect said first and second plurality of counter-blades.

Other features of the present invention and related embodiments are defined by the dependent claims.

According to another aspect of the invention, a machine for converting paper, or similar product, comprising a folding, or interfolding, unit, as above described.

According to a further aspect of the invention, a method for folding, or interfolding, a first and a second plurality of sheets of paper comprises the steps of:

- feeding a first and a second web of paper respectively along a first and a second feeding direction;
- folding, or interfolding, said first and second plurality of sheets of paper at a predetermined folding, or interfolding, zone, of a machine for paper converting, or similar product, said step of folding, or interfolding, being carried out by a first and a second counter-rotating folding, or interfolding, rolls between which said folding, or interfolding, zone is defined, each said first and second folding, or interfolding, roll providing:
  - a tubular body configured to rotate about a respective longitudinal rotational axis, and providing a plurality of suction holes organized according to a predetermined number of couples of longitudinal rows close to each other;
  - a vacuum generation device configured to produce a predetermined vacuum degree;
  - a vacuum distribution device configured to selectively put into pneumatic communication said vacuum generation device with at least a row of suction holes of said plurality, at predetermined angular positions of said tubular body, in such a way to cause said plurality of processed sheets of paper to be sucked at predetermined portions of said first, or second, folding, or interfolding, roll;
- separation carried out downstream of said folding, or interfolding, unit, of a finished stack of folded, or interfolded, sheets, from a following forming stack of folded, or interfolded, sheets by a first and a second plurality of separator members configured to enter from opposite sides with respect to said finished and forming stacks;

whose main characteristic of the method is that said first and said second folding, or interfolding, rolls are, respectively, associated to a first and to a second cutting device, providing, respectively, at least a first and a second cutting blade, and that each said first and second folding, or interfolding, roll provides, respectively, a first and a second plurality of counter-blades distributed along said respective tubular body and configured to operate, respectively, in combination with said first and second cutting blade in order to cut a first and a second web of paper, or similar product, in said first and said second plurality of sheets and that said separation of said finished stack from said following forming stack is carried out by moving said first and second plurality of separator members between a first position and a second position along a respective displacement trajectory positioned outside the encumbrance of said first and second folding, or interfolding, rolls in such a way not to intersect said first and second plurality of counter-blades.

BRIEF DESCRIPTION OF THE DRAWINGS

The invention will now be shown with the following description of its exemplary embodiments, exemplifying but not limitative, with reference to the attached drawings in which:

FIG. 1 diagrammatically shows a partially sectioned front view of a first embodiment of a folding, or interfolding, unit, according to the invention;

FIG. 2 shows an enlargement of a folding, or interfolding, zone, of the folding, or interfolding, unit of FIG. 1 in order to highlight some technical characteristics;

FIG. 3 diagrammatically shows a partially sectioned front view of a possible alternative embodiment of the folding, or interfolding, unit of FIG. 1;

FIG. 4 shows an enlargement of the folding, or interfolding, zone, of the folding, or interfolding, unit of FIG. 3 in order to highlight technical characteristics;

DETAILED DESCRIPTION OF SOME EXEMPLARY EMBODIMENTS OF THE INVENTION

Figure 5A:
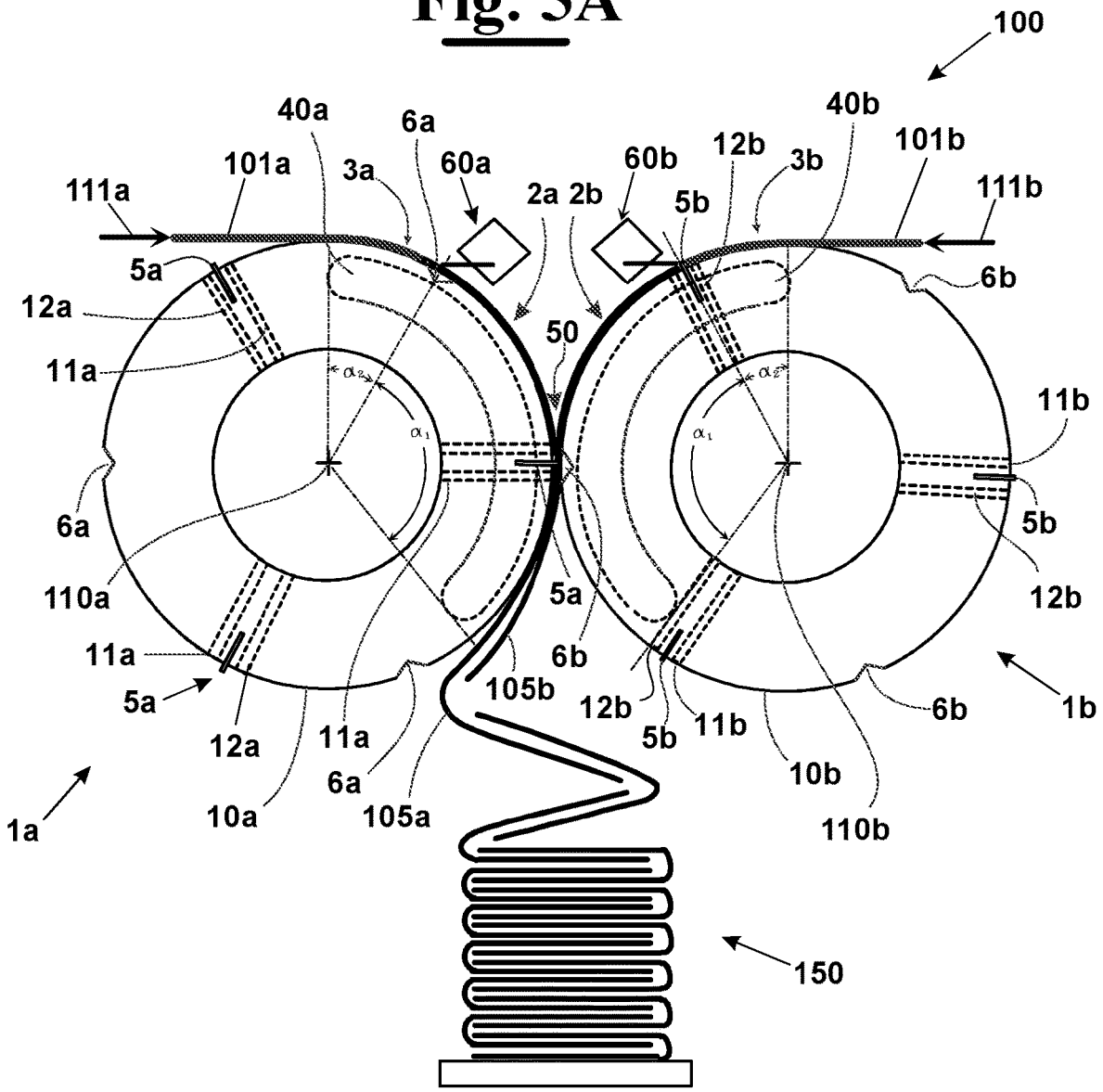
FIGS. 5A to 6B diagrammatically show further alternative embodiments of the folding, or interfolding, unit according to the invention.

In FIG. 1, is diagrammatically shown a first embodiment according to the invention of a folding, or interfolding, unit, 100 of a first and a second plurality of sheets of paper 105*a* and 105*b* having a predetermined length and arranged to be folded, or interfolded, at a predetermined folding, or interfolding, zone, 50 of a machine for paper converting. In particular, the folding, or interfolding, unit 100 comprises a first and a second counter-rotating folding, or interfolding, roll 1*a* and 1*b* between which the aforementioned folding, or interfolding, zone, 50 is defined. Each aforementioned first and second folding, or interfolding, roll 1*a*, or 1*b*, provides a tubular body 10*a*, or 10*b*, configured to rotate about a respective longitudinal rotational axis 110*a*, or 110*b*, and providing a plurality of suction holes 11*a* and 12*a*, or 11*b* and 12*b*, organized according to a predetermined number of couples of longitudinal rows close to each other. A vacuum generation device, which is not shown in the figures for simplicity, but however of known type to a man skilled in the art in the technical field of reference, is, furthermore, provided configured to produce a predetermined vacuum degree. Each folding, or interfolding, roll 1*a*, or 1*b*, is, furthermore, provided of a vacuum distribution device, arranged to operate for sucking at least a sheet 105*a*, or 105*b*, or a web of paper 101*a*, or 101*b*, at predetermined portions of the external surface of the tubular body 10*a*, or 10*b*, and, therefore, to cause the sheet to adhere on the corresponding portion of the external surface. More in detail, each vacuum distribution device is configured to selectively put into pneumatic communication at least a row of suction holes 11*a*, 12*a*, or 11*b*, 12*b*, with the aforementioned vacuum generation device at predetermined angular positions of the tubular body 10*a*, or 10*b*, in such a way to cause the first and/or the second plurality of processed sheets of paper 105*a*, or 105*b*, to be sucked at predetermined portions of the first, or the second, folding, or interfolding, roll 1*a*, or 1*b*.

In an embodiment of the invention, each vacuum distribution device 40*a*, or 40*b* can provide a longitudinal cavity, the position of which, in figure, is diagrammatically shown with a broken line, provided within the tubular body 10*a*, or 10*b*. More in particular, the longitudinal cavity 40*a*, or 40*b*, can be permanently connected with the rows of suction holes 11*a*, 12*a*, 11*b*, 12*b*, but selectively connected to the vacuum generation device. In other words, the suction in the longitudinal cavity 40*a*, or 40*b*, of tubular body 10*a*, or 10*b*, and, therefore, in the rows of holes 11*a*, or 11*b*, or 12*a*, or 12*b*, can be activated only at determined angular positions of the holes. This result can be, for example, obtained by electrovalves, or by lateral suction sectors which provides to connect the vacuum generation device to the longitudinal cavity 40*a*, or 40*b*, of tubular body 10*a*, or 10*b*, only in predetermined angular positions. Advantageously, the aforementioned lateral suction sectors can be bell vacuum distributors arranged coaxially at an end of the tubular body 10*a*, or 10*b*. In particular, each bell vacuum distributor develops coaxially to the tubular body 10*a*, or 10*b*, and is, preferably, fixed. Therefore, during the rotation of the tubular body 10*a*, or 10*b*, zones, or sectors, are formed at which the holes 11*a*, or 11*b*, or 12*a*, or 12*b*, sucks and, therefore, keep at least a sheet 105*a*, or 105*b*, on the surface of the respective tubular body 10*a*, or 10*b*, and, instead, other zones, or sectors, at which no suction is carried out.

Figure 6A:
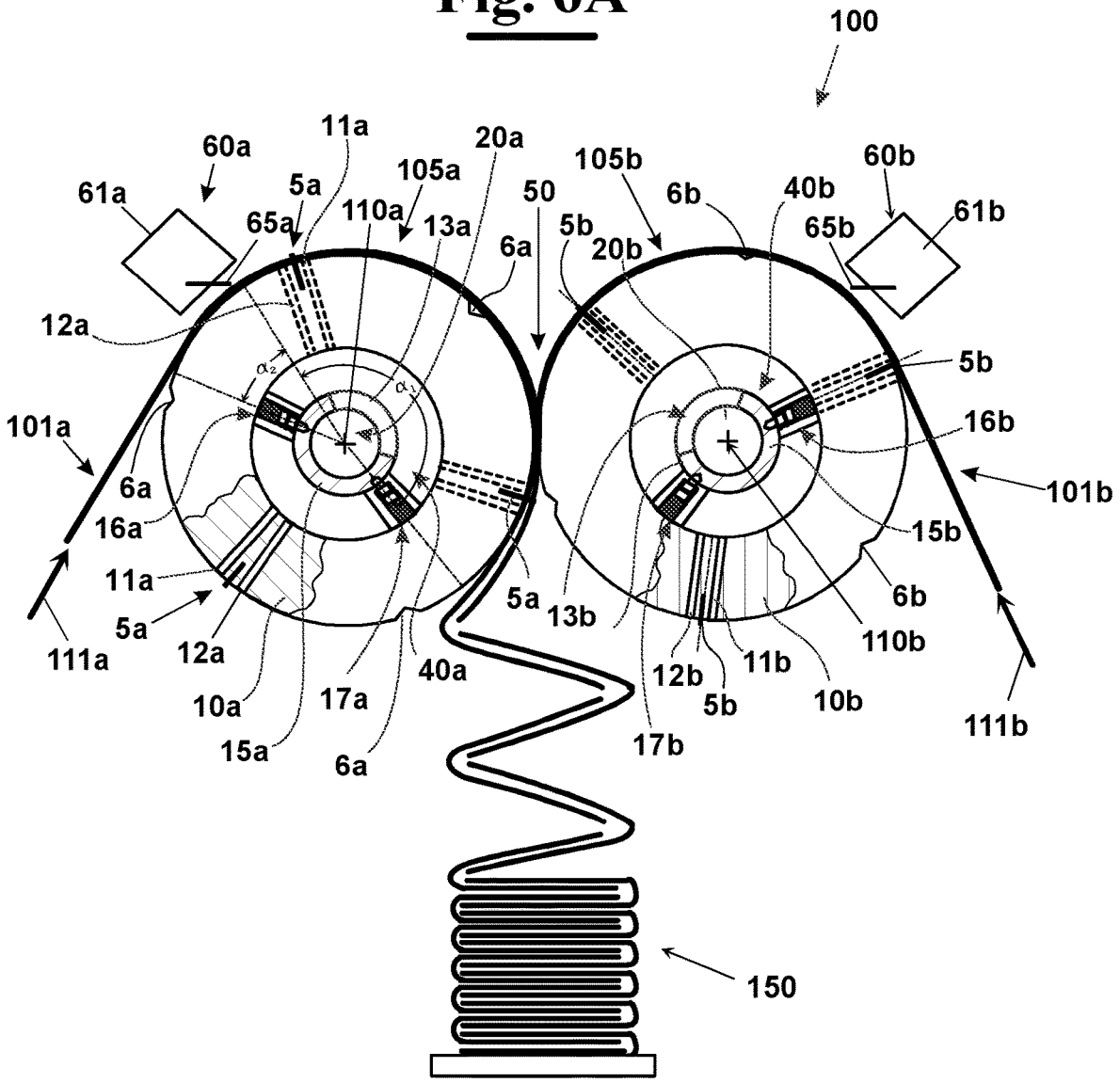

Alternatively to the aforementioned technical solution, as diagrammatically shown in FIG. 6A, in a possible embodiment of the invention, the first and the second plurality of sheets 105*a* and 105*b*, and in case also of the web of paper 101*a*, or 101*b*, can be sucked and maintained on respective suction portions of roll 1*a*, or roll 1*b*, by a suction system analogous to the one described in EP1457444 in the name of the same Applicant. In particular, each folding, or interfolding, roll 1*a*, or 1*b*, can comprise a cylindrical tubular body 10*a*, or 10*b*, providing a series of holes 11*a*, 12*a*, 11*b*, 12*b*, organized according to substantially longitudinal rows, and an internal body 15*a*, or 15*b*, that is coaxial to the aforementioned cylindrical tubular body 10*a*, or 10*b*. More in detail, whilst the cylindrical tubular body 10*a*, or 10*b*, is configured to rotate about its longitudinal axis 110*a*, or 110*b*, the internal body 15*a*, or 15*b* is fixed and is connected to a vacuum generation device, that is not shown in the figure for simplicity. The internal body 15*a*, or 15*b*, for example cylindrical tubular shaped analogously to the external body 10*a*, or 10*b*, has one, or more apertures 13*a*, 13*b*, and two lateral boards 16*a* and 17*a*, or 16*b* and 17*b*, arranged at opposite sides with respect to the apertures 13*a*, or 13*b*. The lateral boards 16*a* and 17*a*, or 16*b* and 17*b*, are radially arranged for all the length of the internal tubular body 15*a*, or 15*b*, and are able to provide a perfect sealing isolating the suction chamber 20*a*, or 20*b*, from the remaining portion of space comprised between the two tubular bodies 10*a* and 15*a*, or 10*b* and 15*b*. This result can be achieved, for example, arranging the boards in a fixed portion integral to the second internal tubular body 15*a*, or 15*b*, and forming a longitudinal seat, and a portion that can move with respect to the fixed portion and arranged to press, advantageously elastically press, against the internal surface of the internal tubular body. The internal surface of the external tubular body together with the boards and the external surface of the internal tubular body define a suction chamber, which selectively connects some rows of holes of the external tubular body with the apertures of the internal tubular body and, therefore, with the suction system of the machine during the relative rotation of the two bodies.

Figure 6B:
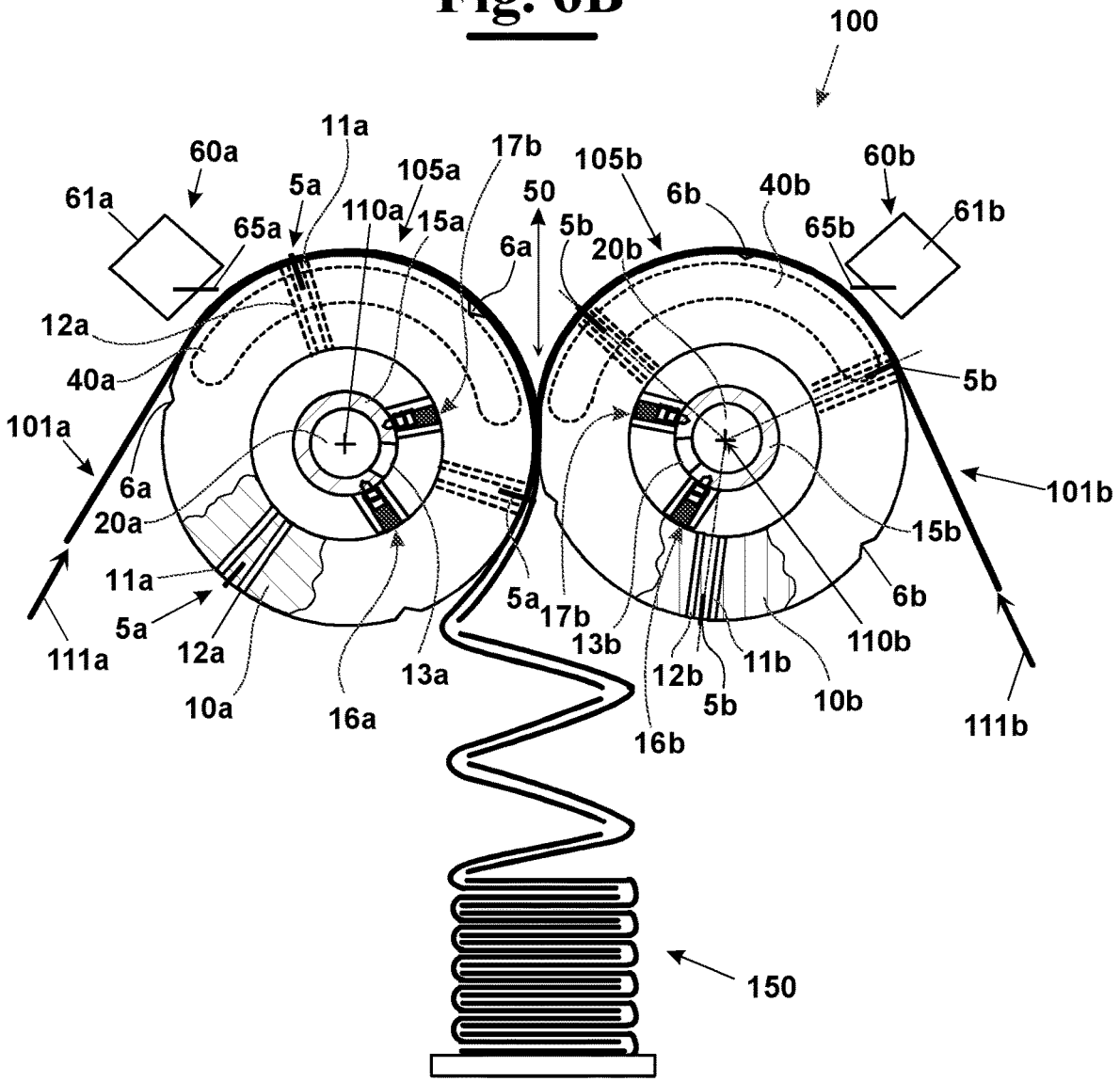

Furthermore, according to the invention, as diagrammatically shown in FIG. 6B, the possibility is also provided to have a vacuum distribution device 40*a*, or 40*b*, of the "hybrid" type, i.e. comprising both the aforementioned technical solutions.

As shown, for example in FIG. 1, each vacuum distribution device 40*a*, or 40*b*, is configured to suck the first and the second plurality of sheets of paper, 105*a* and 105*b* at a first suction portion 2*a*, or 2*b*, positioned downstream of the cutting device 60*a*, or 60*b*, i.e. at the surface of the tubular body 10*a*, or 10*b*, and corresponding to a central angle $\alpha$1. In some cases, in order to increase the stability of the webs of paper 101*a* and 101*b* on the respective rolls 1*a* and 1*b*, it is preferable that each vacuum distribution device 40*a*, or 40*b* sucks the first, or the second, web of paper 101*a*, or 101*b*, on the first, or the second, folding, or interfolding, roll 1*a*, or 1*b*, also at a second suction portion 3*a*, or 3*b*, positioned upstream of the first, or the second, cutting device 60*a*, or 60*b*, and corresponding to a central angle $\alpha$2.

According to the present invention, the folding, or interfolding, unit, 100, furthermore, comprises, a first and a second cutting device 60*a*, 60*b*, respectively, associated to the first and to the second folding, or interfolding, roll 1*a*, 1*b*. More precisely, the first and the second cutting device 60*a* and 60*b* can provide, respectively, at least a first and a second cutting blade 65*a*, or 65*b*, for example mounted on a respective, preferably fixed, support body 61*a*, or 61*b*.

More in detail, the first and the second folding, or interfolding, rolls 1*a*, or 1*b*, provide, respectively, a first and a second plurality of counter-blades 5*a* and 5*b*, distributed on the respective tubular body 10*a* and 10*b*. The counter-blades 5*a* and 5*b* are configured to operate, respectively, in combination with the first and the second cutting blades 65*a* and 65*b*, in order to divide a first and a second web of paper 101*a* and 101*b*, that are fed along a first and a second feeding direction 111*a* and 111*b*, in the aforementioned first and second plurality of sheets 105*a* and 105*b*, of predetermined length. In a particular configuration, as shown, for example, in FIG. 1, the first and the second feeding direction 111*a* and 111*b* are tangent to the respective folding, or interfolding, roll 1*a* and 1*b*. More in particular, the first and the second feeding direction 111*a* and 111*b* are such that the webs of paper 101*a* and 101*b* are, advantageously, fed from below to the rolls 1*a*, and 1*b*.

Figure 5B:
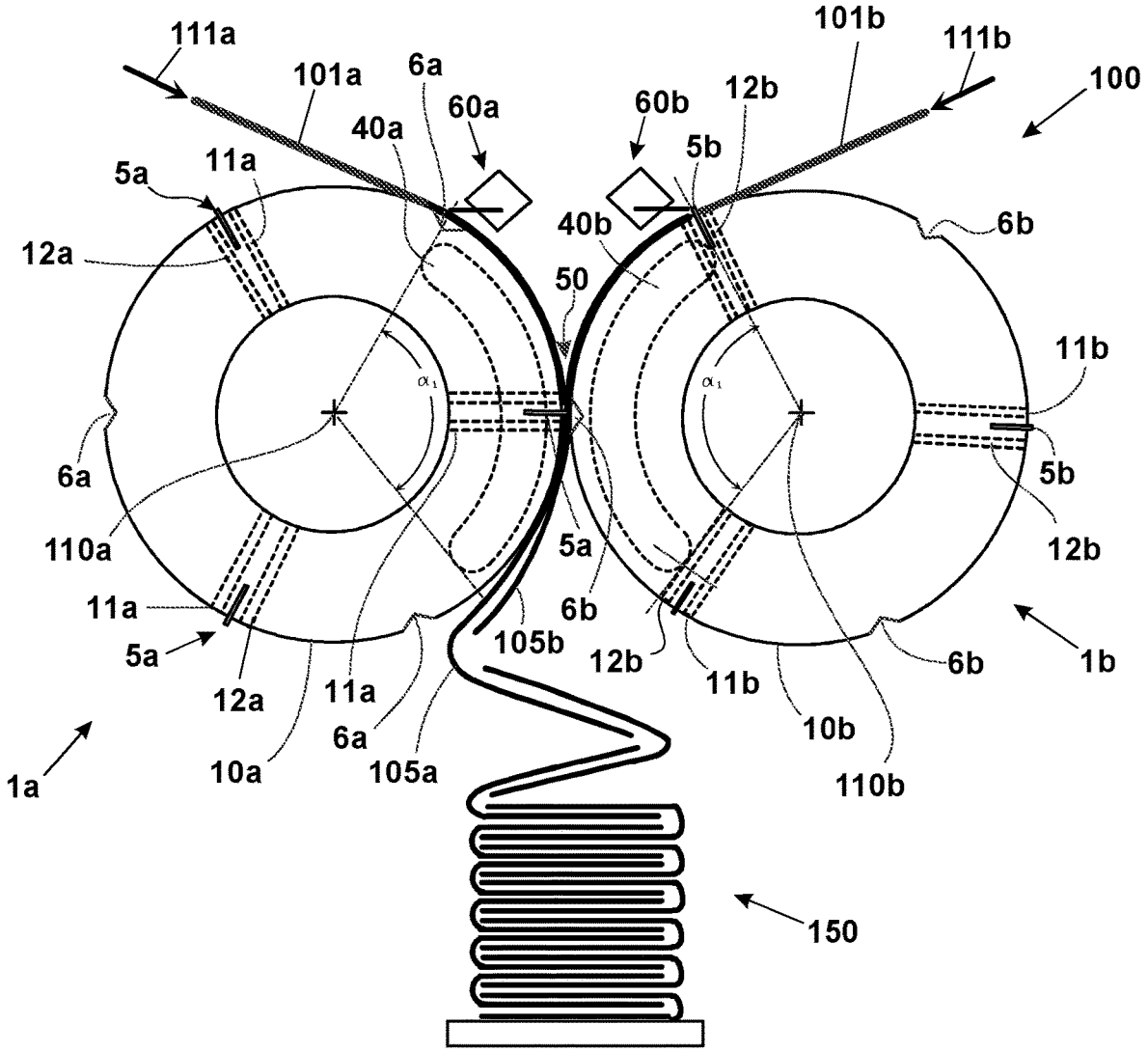

In the embodiments according to the invention that are diagrammatically shown in FIGS. 5A and 5B, it is provided to position the support bodies 61*a*, or 61*b*, for example close to the folding zone 50, and to feed the webs of paper 101*a*, 101*b* about a respective feeding roll, which is not shown in the figures for simplicity, but that is, for example, drawn near a respective folding, or interfolding, roll 1*a*, or 1*b*, in such a way to obtain a feeding direction 111*a*, 111*b* of the webs of paper 101*a*, 101*b* along a substantially horizontal direction (FIG. 5A) or from above to below (FIG. 5B).

Advantageously, the first and the second plurality of counter-blades 5*a* and 5*b*, are positioned, respectively, on the first, and on the second, tubular body 10*a* and 10*b*, at predetermined angular positions such to be positioned at a constant angular distance. For example, on each roll 1*a*, or 1*b*3, can be provided counter-blades 5*a* and 5*b*, which are positioned at angular positions such that the central angle between two successive angular positions is equal to 120°. The possibility is also provided that the number of counter-blades 5*a* and 5*b* on each roll 1*a* and 1*b* can be, however, greater than 3, for example equal to 6. In this case, the central angle between two successive angular positions is equal to 60°.

In the embodiment diagrammatically shown in the FIGS. 1 and 2, in order to avoid that the counter-blades 5*a* and 5*b* can cut the sheets 105*a* and 105*b* in the folding, or interfolding, zone 50, between two rolls 1*a* and 1*b*, the distance d1 between the rolls 1*a* and 1*b* can be greater than the length d2 of the portion of the counter-blades 5*a* and 5*b* protruding from the respective roll 1*a*, or 1*b* (the roll 1*b* in FIG. 2).

In the preferred alternative embodiment shown in the FIGS. 3 and 4, instead, the first and the second tubular bodies 10*a* and 10*b* provide a first and a second plurality of recesses 6*a* and 6*b*, alternate, respectively, to the first and to the second plurality of counter-blades 5*a* and 5*b*. More in particular, the first and the second folding, or interfolding, roll 1*a* and 1*b*, are configured, in this case, in such a way that, at the folding, or interfolding, zone, the counter-blade 5*a*, or 5*b*, of the first, or the second, plurality of counter-blades is arranged to engage a respective recess 6*a*, or 6*b*, of the second, or the first, plurality of recesses. Therefore, in this case, it is not necessary to space the folding, or interfolding, rolls 1*a* and 1*b* at a particular distance from each other as in the case of FIGS. 1 and 2.

Preferably, each counter-blade 5*a*, or 5*b*, of the first, or the second, plurality of counter-blades is positioned between two suction holes of the same couple of suction holes close to each other (see at this regard the enlargements depicted in the FIGS. 2 and 4).

Figure 7:
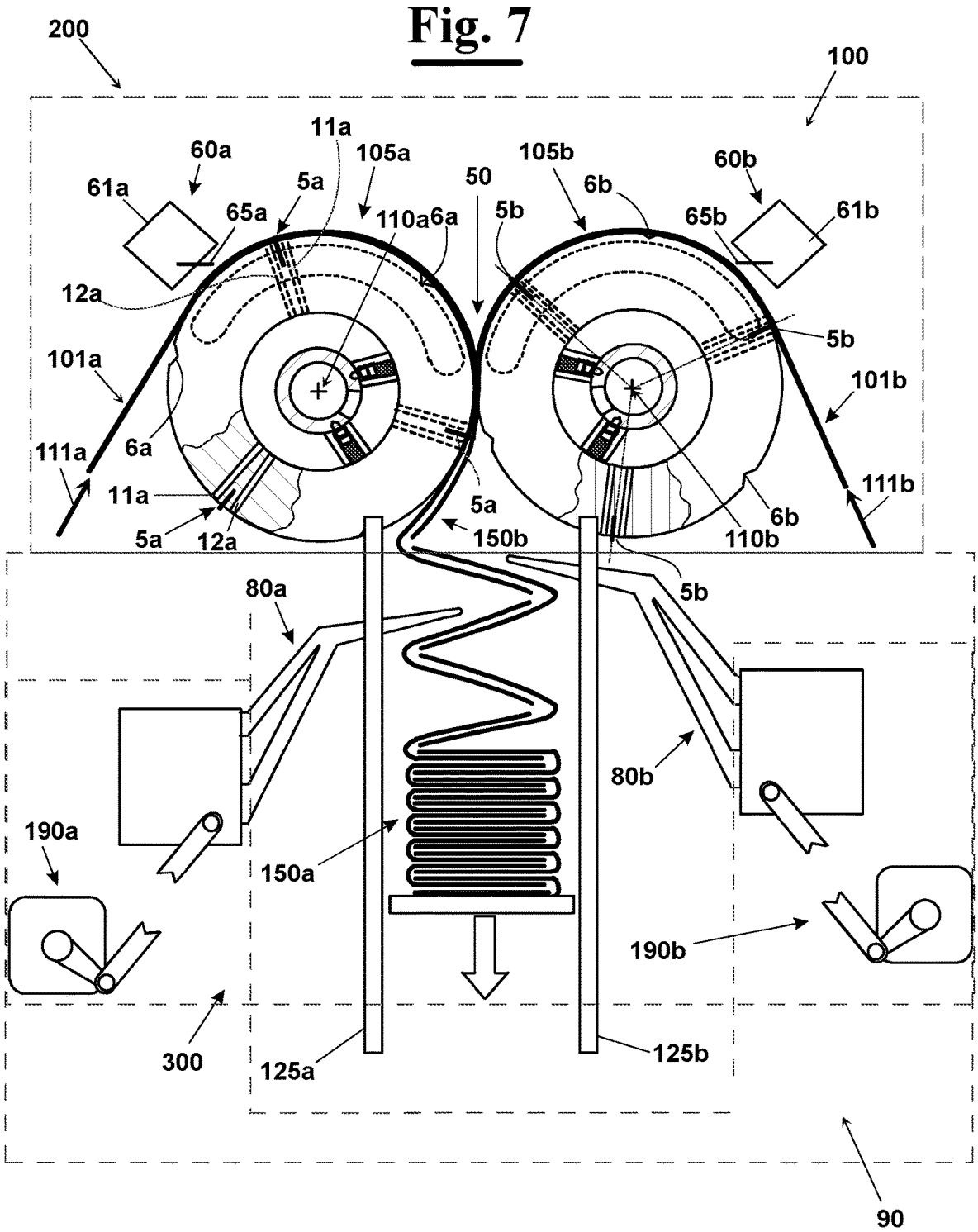
FIG. 7 diagrammatically shows a partially sectioned front view of a possible embodiment of a machine comprising a folding, or interfolding, unit, and a separation unit, according to the invention.
Figure 8:
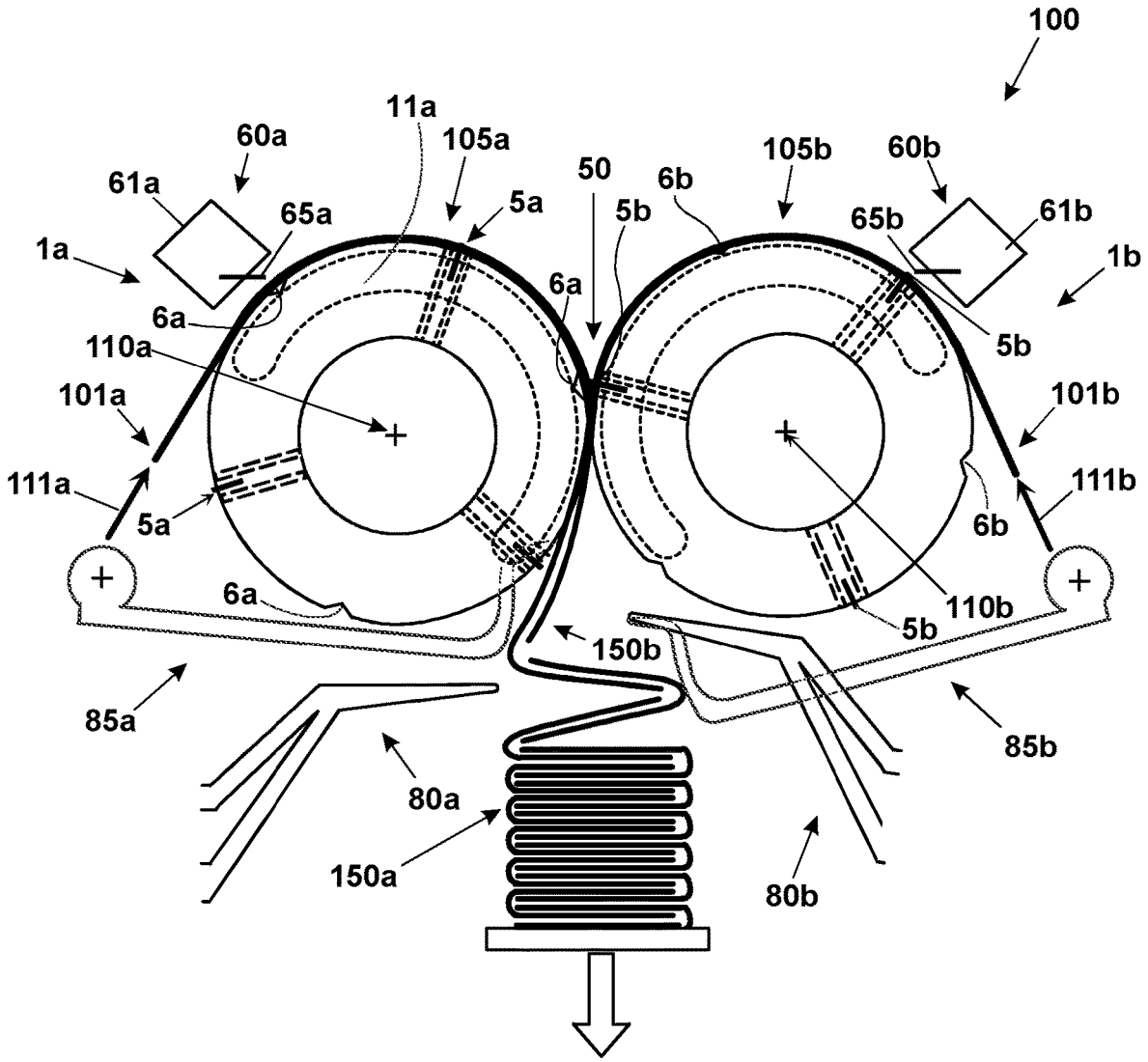
FIG. 8 diagrammatically shows a front view of the folding, or interfolding, unit, according to the invention in order to highlight some technical characteristics.

In FIG. 7, a machine 200 for converting paper, or similar product, is diagrammatically shown comprising a folding, or interfolding, unit, 100 as above described with reference to FIGS. 1 to 6B.

The machine 200 can advantageously, furthermore, provide a removing unit comprising a first plurality of removing members 85*a*, and a second plurality of removing members 85*b*, or removing fingers, configured to act, respectively, at the first and the second folding roll 1*a* and 1*b* to remove the sheets from the respective folding, or interfolding, roll 1*a*, or 1*b*. More precisely, the first and the second plurality of removing members 85*a* and 85*b* and the folding rolls 1*a* and 1*b* are, advantageously, displaced in phase from each other in such a way to, alternately, advance laterally towards sheet 105*a*, or 105*b*, and to move away the same from the respective roll 1*a*, or 1*b*, thus, causing the sheet same to be removed from the surface of the roll to which it adheres, without, anyway, interfering with the aforementioned counter-blades 6*a*, or 6*b*.

In some particularly advantageous embodiments of the invention, the phase between the removing members 85*a* and 85*b* and the folding, or interfolding, rolls 1*a* and 1*b* can be mechanically carried out. More in particular, each removing member 85*a* and 85*b* can be moved from an internal position to a respective groove, that is not shown in the figures for simplicity, provided in the folding rolls 1*a* and 1*b*, to a position external to the folding rolls 1*a* and 1*b* same, in such a way to cause the sheets 105*a*, 105*b* to be "detached" from the respective folding rolls 1*a* and 1*b*. With the expression "mechanical phase" it is to be intended that the removing members 85*a* and 85*b* and the folding rolls 1*a* and 1*b* are mechanically connected to each other, in particular by gears and/or cams, in particular desmodromic cams, and/or pulleys actuated by the same motor, or by different motors in phase from one another, that means such that are able to give the same law of motion to the kinematic mechanism.

According to a particular embodiment of the invention, the removing members 85*a* and 85*b* can have a geometry such that they do not interfere with the plurality of counter-blades 5*a* and 5*b* of rolls 1*a* and 1*b*. For example, as diagrammatically shown in FIGS. 9A and 9B, the removing members 85*a* and 85*b* can be substantially "S"-shaped, or substantially "Z"-shaped.

In particular, still as diagrammatically shown in FIG. 7, the machine 200 provides, furthermore, a separation unit 300 comprising a first and a second plurality of separator members 80*a* and 80*b*, configured to enter from opposite sides in a finished stack of folded, or interfolded, sheets, 150*a*, that is, for example, moved between lateral containment grid elements 125*a* and 125*b*, and separate the same from a following stack of folded, or interfolded, sheets 150*b* without interfering with the aforementioned plurality of counter-blades 5*a* and 5*b* of folding, or interfolding, rolls 1*a* and 1*b*. More in particular, a displacement unit 90 is provided configured to move the separator members 80*a* and 80*b* between a first and a second position along a predetermined displacement trajectory. In the example of FIG. 7, the displacement unit comprises a first and a second displacing device 190*a* and 190*b*, but is, anyway, also provided the possibility that the displacement unit 90 can be constituted by only one displacing device connected to the first and the second plurality of separator members 80*a* and 80*b* in such a way to synchronously and alternately move the same to separate the finish stack of sheets 150*a* from the forming stack 150*b*. More precisely, as soon as a last sheet 105*a*, or 105*b*, of stack 150*a* is removed from the respective folding roll 1*a*, or 1*b*, and positioned on the stack of interfolded sheets, the respective separator member, for example the separator member 80*a*, is introduced within the stack for a corresponding portion of the same, normally up to half of the stack, carrying out a separation between a sheet and the following one. The other separator member, for example the separator member 80*b*, is introduced in the stack from the other side, but staggered by half sheet with respect to the separator member 80*a*. In other words, a separator member 80*a*, or 80*b*, is introduced into the stack staggered in time by half sheet with respect to the other separator member 80*b*, or 80*a*, for separating a finished stack 150*a* from the following forming stack 150*b*.

Figure 9A:
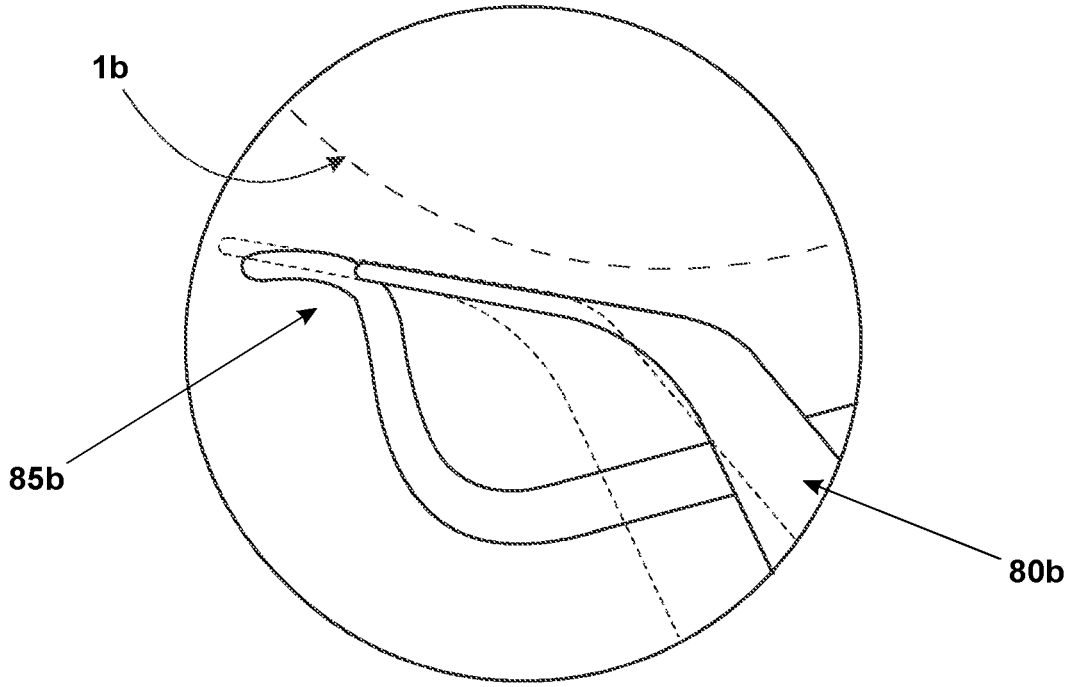
FIGS. 9A and 9B diagrammatically show in a respective front view, 2 different snapshots of a possible succession of steps carried out by the folding, or interfolding, unit, according to the invention.
Figure 9B:
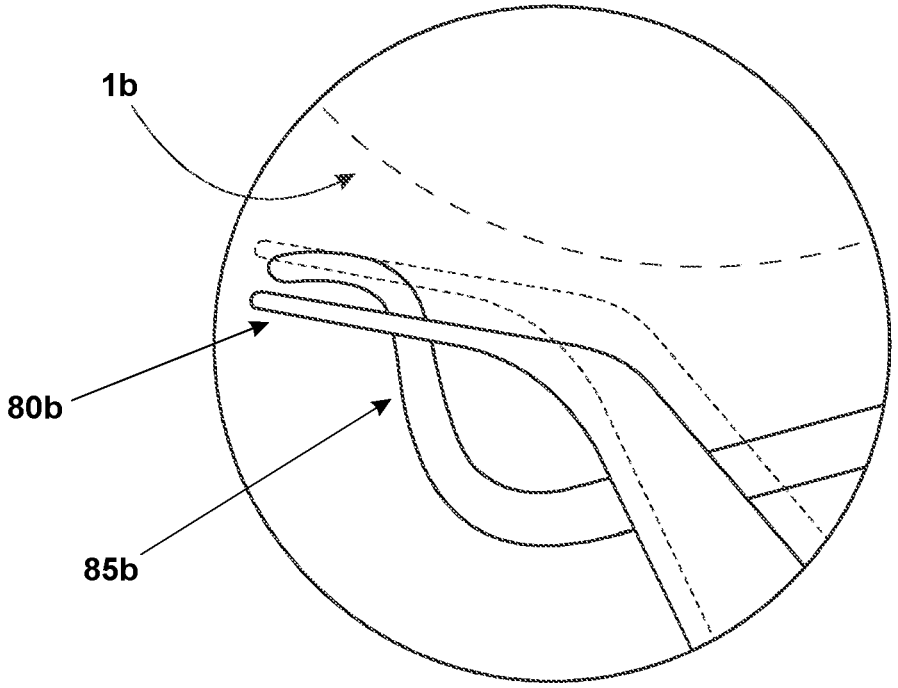

As diagrammatically shown in the two snapshots depicted in the FIGS. 9A and 9B, the displacement unit 90 can be configured to move the first and the second plurality of separator members 80*a* and 80*b* along a respective displacement trajectory between a first position (indicated with an unbroken line in FIG. 9A) and a second position (indicated with an unbroken line in FIG. 9B) positioned outside the encumbrance of the first and the second folding, or interfolding, roll 1*a* and 1*b* (in the FIGS. 9A and 9B is indicated the encumbrance of roll 1*b*) like any other position intermediate to the same (positions indicated with broken lines in the FIGS. 9A and 9B). In this way, during all the formation step of the stack of folded, or interfolded, sheets 150, the separator members 80*a* and 80*b* does not interfere with the aforementioned first and second plurality of counter-blades 5*a* and 5*b* of folding, or interfolding, rolls 1*a* and 1*b*.

The displacement unit 90 can be electronically in phase with the folding, or interfolding, rolls 1*a* and 1*b* and with the removing members 85*a* and 85*b*. In this case, kinematic connection mechanisms between the different components are not provided. The actuation of the displacement unit 90 is, advantageously, operated by an electronic control unit configured to detect, during the cycle of the machine, the instant in which the separator members 80*a* and 80*b* have to be inserted in the stack of folding, or interfolding, sheets.

In a further alternative embodiment of the invention also the displacement unit 90 can be mechanically in phase with the other parts of the folding machine. In this case, the change of the length of the stack can be, advantageously, carried out by stopping the machine and modifying the part of the machine adjusting the phase between the displacement unit 90 and the other parts of the folding machine.

Advantageously, in a further alternative embodiment of the invention that is not shown for simplicity, the folding, or interfolding, machine providing of the folding, or interfolding, unit, as above described with reference to FIGS. 1 to 7 can have a modular structure of the type described in EP1630118. More precisely, the folding, or interfolding, machine can provide a fixed framework on which can be mounted, for example able to slide, cutting and folding, or interfolding, modules that can move with respect to the fixed framework. Each module comprises a folding, or interfolding, roll with a predetermined number of counter-blades, a particular diameter, and a respective cutting device. In this way, it is possible to change a module with a different one for changing the working configuration of the machine, and, therefore, the type of product. With respect to the prior art solutions, in particular the solution described in EP1630118, the machine according to the invention allows to simplify and to speed up in case a change of working configuration, since only the folding rolls have to be changed.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A folding, or interfolding, unit, for folding, or interfolding a first and a second plurality of sheets of paper of a predetermined length and arranged to be folded, or interfolded, at a predetermined folding, or interfolding, zone, of a machine for converting paper, or similar product, said folding, or interfolding, unit comprising:

first and second folding, or interfolding, counter-rotating rolls between which said folding, or interfolding, zone is defined, each said first and second folding, or interfolding, rolls, providing:

a tubular body configured to rotate about a respective longitudinal rotational axis, and a plurality of suction holes being provided organized according to a predetermined number of longitudinal rows close to each other;

a vacuum generation device configured to produce a predetermined vacuum degree;

a vacuum distribution device configured to selectively put into pneumatic communication said vacuum generation device with at least a row of said plurality of rows of suction holes, at predetermined angular positions of said tubular body, in such a way to cause said plurality of processed sheets of paper to be sucked and to adhere at predetermined portions of said first, or second, folding, or interfolding, roll;

a separation unit arranged to operate downstream of said folding, or interfolding, unit, said separation unit comprising a first and a second plurality of separator members configured to enter from opposite sides in a finished stack of folding, or interfolding, sheets, and to separate the same from a following forming stack of folded, or interfolded, sheets;

a displacement unit configured to move said first plurality of separator members and said second plurality of separator members;

a first and a second cutting device respectively associated to said first and to said second folding, or interfolding, roll said first and second cutting device, providing, respectively, at least a first and a second cutting blade, wherein:

each said first and second folding, or interfolding, roll provides, respectively, a first and a second plurality of counter-blades distributed along said respective tubular body and configured to operate, respectively, in combination with said first and second cutting blades to divide a first and a second web of paper, or similar product, in said first and said second plurality of sheets, and said displacement unit is configured to move said first and second plurality of separator members between a first position and a second position along a respective displacement trajectory positioned outside the encumbrance of said first and second folding, or interfolding, rolls during the formation of said stack of folded, or interfolded, sheets in such a way not to intersect said first and second plurality of counter-blades.

2. The folding, or interfolding, unit, according to claim 1, wherein said first and second tubular bodies provide, furthermore, a first and a second plurality of recesses alternated, respectively, to said first and second plurality of counter-blades, said first and second folding, or interfolding, rolls being configured in such a way that, at said folding, or interfolding, zone, a counter-blade of said first, or second, plurality of counter-blades is arranged to engage a respective recess of said second, or first, plurality of recesses.

3. The folding, or interfolding, unit, according to claim 2, wherein said first and second plurality of counter-blades are positioned, respectively, on said first, and said second, tubular body at predetermined angular positions in such a way to be positioned at a constant angular distance.

4. The folding, or interfolding, unit, according to claim 2, wherein each said vacuum distribution device is configured to suck said first, or said second, plurality of sheets of paper, at a first suction portion positioned downstream of said cutting device and to suck said first, or said second, web of paper on said first, or said second, folding, or interfolding, roll at a second suction portion positioned upstream of said first, or second, cutting device.

5. The folding, or interfolding, unit, according to claim 4, wherein said first and second plurality of counter-blades are positioned, respectively, on said first, and said second, tubular body at predetermined angular positions in such a way to be positioned at a constant angular distance.

6. The folding, or interfolding, unit, according to claim 4, wherein said first and second plurality of counter-blades are positioned, respectively, on said first, and said second, tubular body at an angular distance of 120° one with respect to the other.

7. The folding, or interfolding, unit, according to claim 2, wherein said first and second plurality of counter-blades are positioned, respectively, on said first, and said second, tubular body at an angular distance of 120° one with respect to the other.

8. The folding, or interfolding, unit, according to claim 2, wherein each counter-blade of said first and said second plurality of counter-blades is positioned between two suction holes of the same couple of suction holes close to each other.

9. A machine for converting paper, or similar product, comprising the folding, or interfolding, unit, according to claim 2.

10. The folding, or interfolding, unit, according to claim 1, wherein each said vacuum distribution device is configured to suck said first, or said second, plurality of sheets of paper, at a first suction portion positioned downstream of said cutting device and to suck said first, or said second, web of paper on said first, or said second, folding, or interfolding, roll at a second suction portion positioned upstream of said first, or second, cutting device.

11. The folding, or interfolding, unit, according to claim 10, wherein said first and second plurality of counter-blades are positioned, respectively, on said first, and said second, tubular body at predetermined angular positions in such a way to be positioned at a constant angular distance.

12. The folding, or interfolding, unit, according to claim 1, wherein said first and second plurality of counter-blades are positioned, respectively, on said first, and said second, tubular body at predetermined angular positions in such a way to be positioned at a constant angular distance.

13. The folding, interfolding, unit, according to claim 1, wherein said first and second plurality of counter-blades are positioned, respectively, on said first, and said second, tubular body at an angular distance of 120° one with respect to the other.

14. The folding, or interfolding, unit, according to claim 1, wherein each counter-blade of said first and said second plurality of counter-blades is positioned between two suction holes of the same couple of suction holes close to each other.

15. A machine for converting paper, or similar product, comprising the folding, or interfolding, unit, according to claim 1.

16. The machine for converting paper, or similar product, according to claim 15, wherein a removing unit is, furthermore, provided comprising a first plurality of removing members, and a second plurality of removing members, configured to act, respectively, at said first and second folding, or interfolding, rolls to remove said sheets from the respective folding, or interfolding, roll.

17. The machine for converting paper, or similar product, according to claim 16, wherein said removing members have a geometry such that non interfere with said plurality of counter-blades during said movement carried out by said displacing device.

18. The machine for converting paper, or similar product according to claim 17, wherein said removing members are substantially "S"-shaped, or substantially "Z"-shaped.

19. The machine for converting paper, or similar product according to claim 16, wherein said removing members are substantially "S"-shaped, or substantially "Z"-shaped.

20. A method for folding, or interfolding, a first and a second plurality of sheets of paper comprising the steps of:

feeding a first and a second web of paper, respectively, along a first and a second advancing direction;

folding, or interfolding, said first and said second plurality of sheets of paper at a predetermined folding, or interfolding, zone, of a machine for converting paper, or similar product, said folding, or interfolding step being carried out by a first and a second folding, or interfolding, counter-rotating rolls between which said folding, or interfolding, zone is defined, each of said first and second folding, or interfolding, rolls (1*a*,1*b*), providing:

a tubular body configured to rotate about a respective longitudinal rotational axis, and providing a plurality of suction holes organized according to a predetermined number of couples of longitudinal rows close to each other;

a vacuum generation device configured to produce a predetermined vacuum degree; and a vacuum distribution device configured to selectively put into pneumatic communication said vacuum generation device with at least a row of suction holes of said plurality, at predetermined angular positions of said tubular body, in such a way to cause said plurality of processed sheets of paper to be sucked at predetermined portions of said first, or second, folding, or interfolding, roll; and separating downstream of said folding, or interfolding, unit, of a finished stack of folded, or interfolded, sheets from a following forming stack of folded, or interfolded, sheets by a first and a second plurality of separator members configured to enter from opposite sides with respect to said finished stack and said forming stack, wherein:

said method being characterized in that said first and said second folding, or interfolding, rolls are, respectively, associated to a first and to a second cutting device that are, respectively, provided of at least a first and a second cutting blade;

said first and second folding, or interfolding, roll provides, respectively, a first and a second plurality of counter-blades distributed along said respective tubular body and configured to operate, respectively, in combination with said first and second cutting blades to divide a first and a second web of paper, or similar product, in said first and second plurality of sheets; and said separating step of said finished stack (150*a*) from said following forming stack is carried out by moving said first and second plurality of separator members between a first position and a second position along a respective displacement trajectory positioned outside the encumbrance of said first and second folding, or interfolding, roll in such a way not to intersect said first and second plurality of counter-blades.

* * * * *